US005117883A

United States Patent [19]

Chen

[11] Patent Number: 5,117,883

[45] Date of Patent: Jun. 2, 1992

[54] HANDBAG

[76] Inventor: Charles Chen, No. 70-5, Yueh-Hu Rd., Tun-Pei Ts'un, Hou-Li Hsiang, Taichung Hsien, Taiwan

[21] Appl. No.: 759,460

[22] Filed: Sep. 13, 1991

[51] Int. Cl.[5] ..... A45C 3/02; A45C 13/02

[52] U.S. Cl. ..... 150/118; 190/119; 190/903; 383/14; 383/97

[58] Field of Search ..... 150/118; 190/115, 117, 190/119, 903; 383/14, 97

[56] References Cited

U.S. PATENT DOCUMENTS

| | | | |
|---|---|---|---|
| 2,053,599 | 9/1936 | Brinkerhoff | 150/118 |
| 3,141,536 | 7/1964 | Fulton | 190/119 |
| 4,817,769 | 4/1989 | Saliba | 383/97 |
| 4,821,853 | 4/1989 | Young | 383/97 |
| 4,842,032 | 6/1989 | Mastronardo | 190/903 |

FOREIGN PATENT DOCUMENTS

| | | | |
|---|---|---|---|
| 1150881 | 1/1958 | France | 150/118 |
| 482006 | 3/1938 | United Kingdom | 190/119 |

*Primary Examiner*—Gary E. Elkins

*Attorney, Agent, or Firm*—Ladas & Parry

[57] ABSTRACT

A handbag has a side wall provided with a top rectangular opening. A rectangular flexible cover strip has a first end connected widthwise to the side wall and two peripheral edges. Each of a pair of zippers connects one of the peripheral edges to the side wall to close the opening. An inverted U-shaped handle member has two parallel portions connected to two sliding tabs of the zippers and a handling portion. A stationary shaft extends between the parallel portions. A tubular member is rotatably sleeved around the stationary shaft. The tubular member has an outer surface to which a second end of the cover strip is attached and which is in rolling contact with the cover strip. A torsional spring is mounted in the tubular member and sleeved around the stationary shaft. The handle member is movable between a closed position, wherein the opening is closed by the cover strip, and an opening position. The cover strip is wound around the outer surface of the tubular member when the handle member is moved from the closed position to the opening position.

2 Claims, 5 Drawing Sheets

HANDBAG

BACKGROUND OF THE INVENTION

1. Field of the Invention

This invention relates to a handbag, more particularly to an improved handbag having a rectangular opening, and a rectangular flexible cover strip provided with a strip winding and unwinding unit to close or open the rectangular opening.

2. Description of the Related Art

Referring to FIG. 1, a conventional handbag (1) has a top end face having an opening (1*a*) formed thereon, and a zipper (A) provided thereon to close or opening (1*a*), it is inconvenient for the user to take something out or put something into the handbag (1).

SUMMARY OF THE INVENTION

Therefore, the objective of the invention is to provide an improved handbag which has a rectangular opening of predetermined width, and a rectangular flexible cover strip provided with a strip winding and unwinding unit to close or open the rectangular opening. Thereby, it is convenient for the user to take something out or put something into the handbag. It is also convenient for the rectangular flexible cover strip to close or open the rectangular opening by the strip winding and unwinding unit.

Accordingly, a handbag of this invention has a bag. The bag includes a first end face, an opposite second end face, and a side wall interconnecting the first and second end faces. The first and second end faces and the side wall define a closed chamber. The side wall has a top rectangular opening of predetermined width to access the closed chamber.

A rectangular flexible cover strip has a first end connected widthwise to the side wall adjacent to the opening of the side wall of the bag, an opposite second end, and two peripheral edges extending between the first and second ends. A pair of zip-fasteners has two sliding tabs formed thereon. Each of the zip-fasteners connects one of the two peripheral edges to the side wall to close the opening of the side wall.

A strip winding and unwinding unit includes an inverted U-shaped handle member which has two parallel portions having two free ends respectively connected to the sliding tabs of the zip-fasteners and a handling portion interconnecting the two parallel portions. A stationary shaft extends between the parallel portions and has two ends respectively fixed to the free ends of the parallel portions. A tubular member is rotatably sleeved around, and extends along, the length of the stationary shaft. The tubular member has an outer surface to which the second end of the cover strip is attached and which is in rolling contact with the cover strip. A torsional spring is mounted in the tubular member and sleeved around the stationary shaft. The torsional spring has a first end connected to the tubular member and an opposite second end connected to the stationary shaft. The handle member is movable between a closed position, wherein the opening of the bag is closed by the cover strip, and an opening position. The tubular member is rotated and the cover strip is wound around the outer surface of the tubular member when the handle member is moved from the closed position to the opening position.

The strip winding and unwinding unit further includes a fastening member provided on the side wall of the bag to maintain the handle member in the closed position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
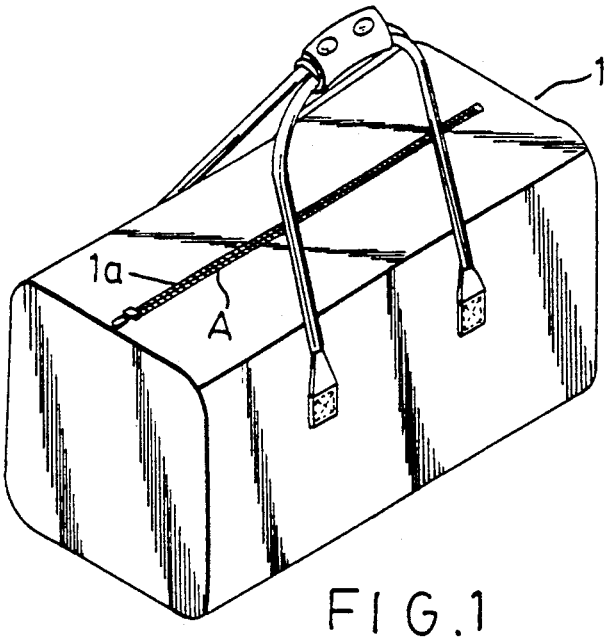
FIG. 1 PRIOR ART
FIG. 1 is a schematic view of a conventional handbag.
Figure 2:
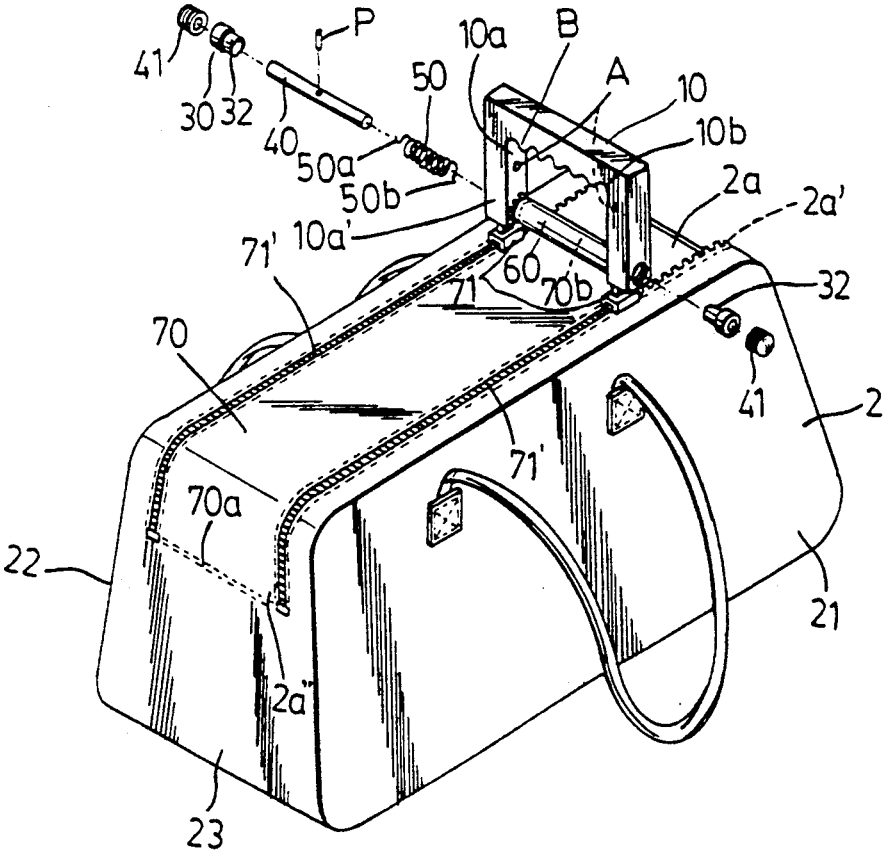
FIG. 2 is a partially exploded view of a preferred embodiment of the handbag of this invention.
Figure 3:
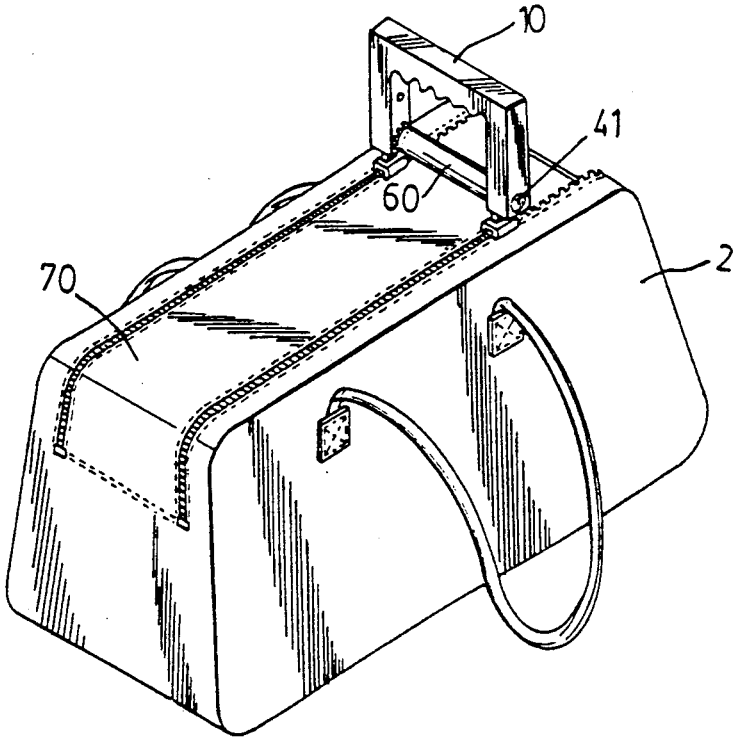
FIG. 3 is a schematic view of the preferred embodiment.
Figure 3A:
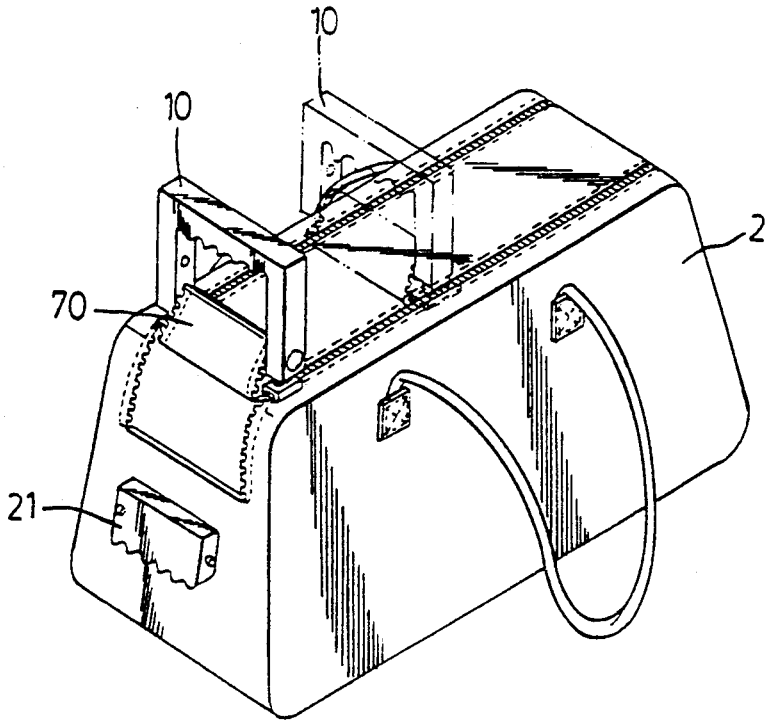
FIG. 3(A) is a schematic view of the preferred embodiment showing that the handle member is moved from the closed position to the opening position.
Figure 4:
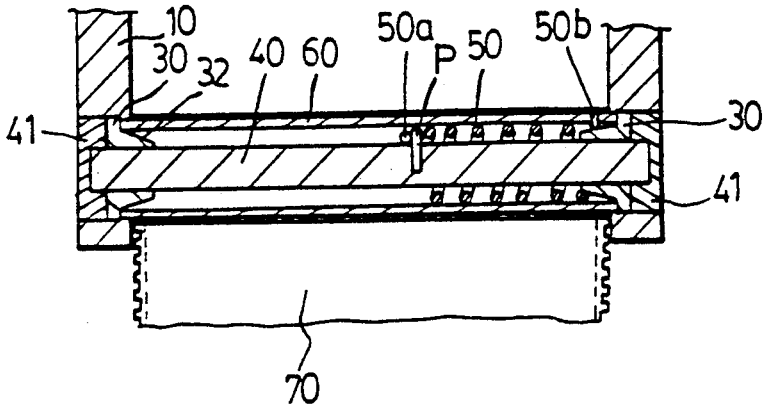
FIG. 4 is a partially sectional view of the strip winding and unwinding unit of the preferred embodiment when the handle member is in an opening position.
Figure 5:
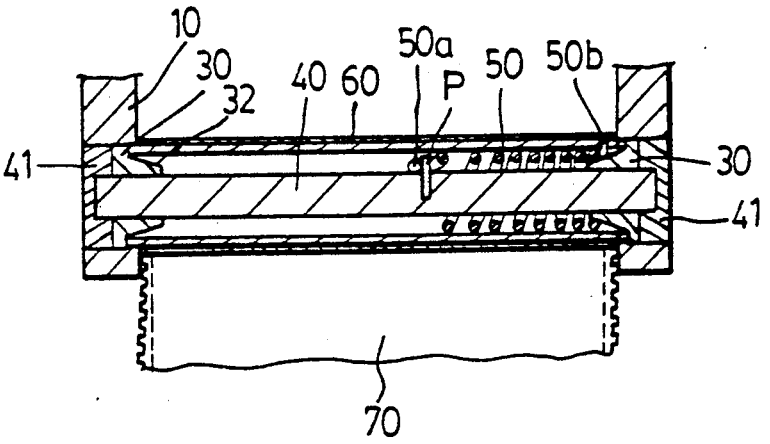
FIG. 5 is a partially sectional view of the strip winding and unwinding unit of the preferred embodiment when the handle member is in a closed position.

Referring to FIGS. 2 to 5, a handbag of this invention has a bag (2). The bag (2) includes a first end face (21), an opposite second end face (22), and a side wall (23) interconnecting the first and second end faces (21, 22). The first and second end faces (21, 22) and the side wall (23) define a closed chamber. The side wall (23) has a top rectangular opening (2*a*) of predetermined width to access the closed chamber.

A rectangular flexible cover strip (70) made of cloth has a first end (70*a*) connected widthwise to the side wall (23) adjacent to the opening (2*a*) of the side wall (23), an opposite second end (70*b*), and two peripheral edges extending between the first and second ends (70*a*, 70*b*). A pair of zip-fasteners (71') has two sliding tabs (71). Each of the zip-fasteners (71') connects one of the two peripheral edges of the cover strip (70) to the side wall (23) in order to close the opening (2*a*) of the bag (2).

A strip winding and unwinding unit includes an inverted U-shaped handle member (10). The handle member (10) includes two parallel portions (10*a*) having two free ends (10*a'*) respectively connected to the sliding tabs (71) of the zip-fasteners (71'), and a handling portion (10*b*) interconnecting the two parallel portions (10*a*). The parallel portions (10*a*) of the handle member (10) has a pair of aligned recesses (A) facing one another. The handling portion (10*b*) of the handle member (10) has a wavy inner face (B). A stationary shaft (40) extends between the parallel portions (10*a*) and has two enlarged heads (41) respectively fixed to the free ends (10*a*') of the parallel portions (10*a*). A tubular member (60) is rotatably sleeved around, and extends along, the length of the stationary shaft (40). An annular plug (30) is provided on each end of the tubular member (60). Each annular plug (30) has a tapered portion (32) extending into the tubular member (60). The tubular member (60) has an outer surface to which the second end (70*b*) of the cover strip (70) is attached and which is in rolling contact with the cover strip (70). A torsional spring (50) is mounted in the tubular member (60) and sleeved around the stationary shaft (40). The torsional spring (50) has a first end (50*a*) fixed to the stationary shaft (40) by a pin member (P), and an opposite second end (50*b*) fixed to the tapered portion (32) of the annular plug (30). The handle member (10) is movable between a closed position (2*a*'), wherein the opening (2*a*) of the bag (2) is closed by the cover strip (70), and an opening position (2*a*''). The tubular member (60) is rotated and the cover strip (70) is wound around the outer surface of the tubular member (60) when the handle member (10) is moved from the closed position (2*a*') to the opening position (2*a*'') by the returning force of the torsional spring (50).

Figure 6:
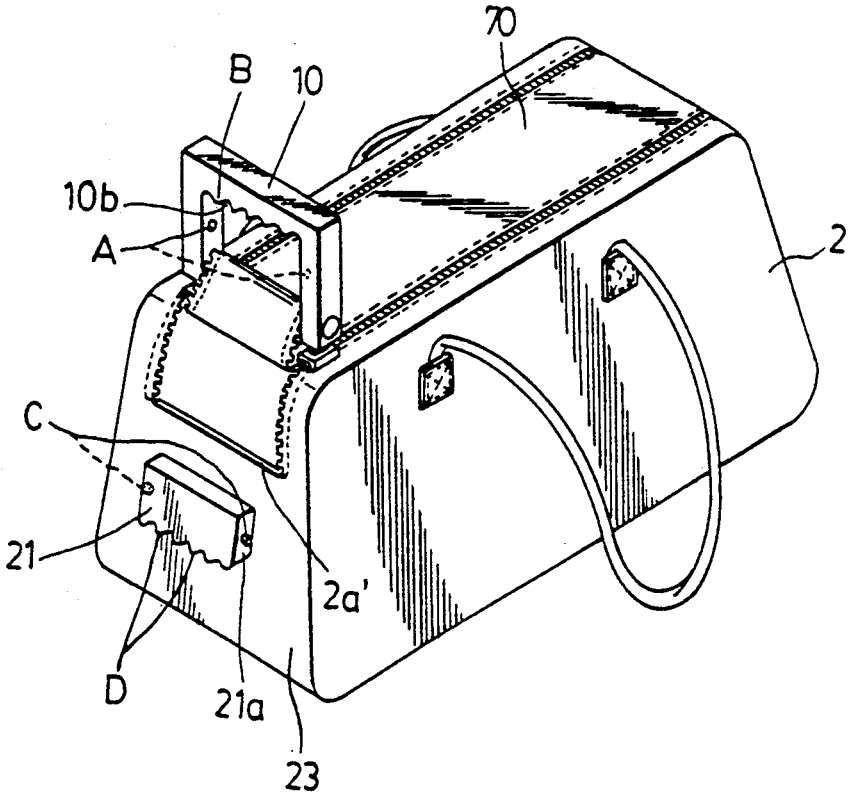
FIG. 6 is a schematic view of the preferred embodiment showing that the handle member is released from the fastening member.
Figure 7:
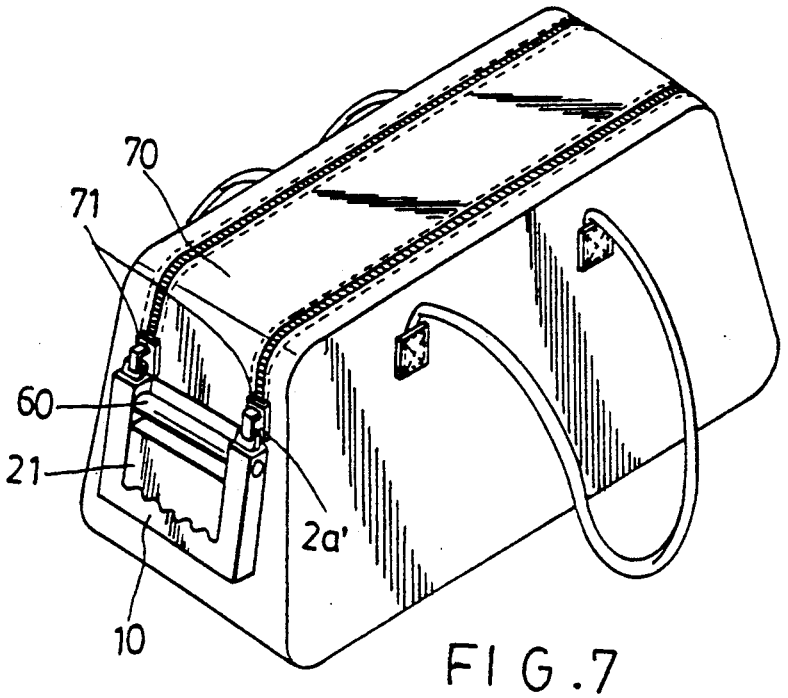
FIG. 7 is a schematic view of the preferred embodiment showing that the handle member is engaged with the fastening member and maintained in the closed position.
Figure 8:
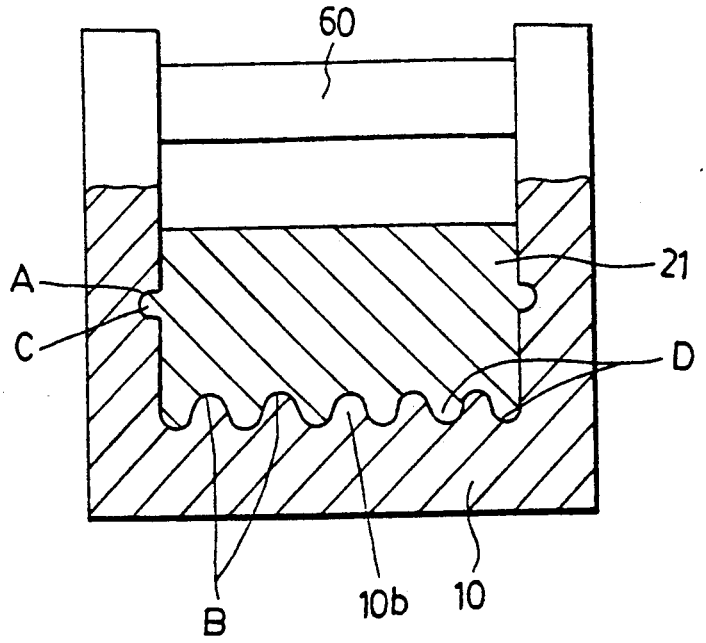
FIG. 8 is a sectional view showing that the handle member is engaged with the fastening member.
Figure 9:
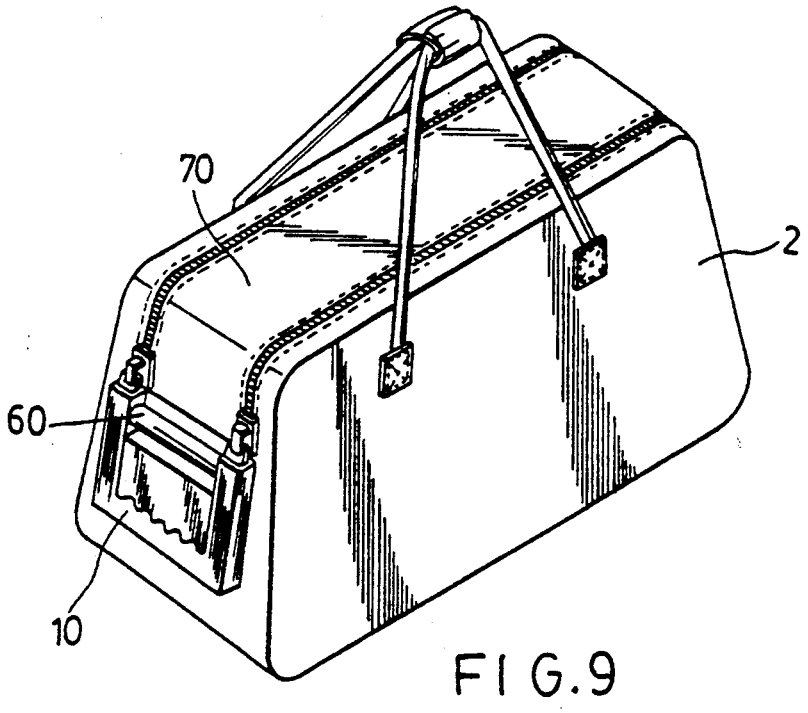
FIG. 9 is a schematic view of the preferred embodiment when the handle member is engaged with the fastening member and maintained in the closed position.

Referring to FIGS. 6 to 9, the strip winding and unwinding unit further includes a fastening member (21) provided on the side wall (23) of the bag (2). The fastening member (21) includes a rectangular member having two opposite upright sides (21*a*) each having a projecting stub (C) received in a respective one of the recesses (A) of the parallel portions (10*a*), and a wavy bottom face (D) to engage the wavy inner face (B) of the handling portion (10*b*) so as to maintain the handle member (10) in the closed position (2*a*').

Therefore, it is convenient for the user to take something out or put something into the handbag through its rectangular opening (2*a*). It is also convenient for the rectangular flexible cover strip (70) to close or open the rectangular opening (2*a*) by the strip winding and unwinding unit.

While the present invention has been described in connection with what is considered the most practical and preferred embodiment, it is understood that this invention is not limited to the disclosed embodiments, but is intended to cover various arrangements included within the spirit and scope of the broadest interpretations and equivalent arrangements.

I claim:

1. a handbag comprising:

a bag including a first end face, an opposite second end face, and a side wall interconnecting said first and second end faces, said first and second end faces and said side wall defining a closed chamber, said side wall having a top rectangular opening of predetermined width to access said closed chamber;

a rectangular flexible cover strip having a first end connected widthwise to said side wall adjacent to said opening of said side wall of said bag, an opposite second end, and two peripheral edges extending between said first and second ends, a pair of zip-fasteners each of which connects one of said two peripheral edges to said side wall of said bag to close said opening of said side wall of said bag, each of said zip-fasteners having a sliding tab;

a strip winding and unwinding unit including an inverted U-shaped handle member which has two parallel portions having two free ends respectively connected to said sliding tabs of said zip-fasteners and a handling portion interconnecting said two parallel portions, a stationary shaft extending between said parallel portions and having two ends respectively fixed to said free ends of said parallel portions, a tubular member rotatably sleeved around and extending along the length of said stationary shaft, said tubular member having an outer surface to which said second end of said cover strip is attached and which is in rolling contact with said cover strip, and a torsional spring mounted in said tubular member and sleeved around said stationary shaft, said torsional spring having a first end connected to said tubular member and an opposite second end connected to said stationary shaft, said handle member being movable between a closed position wherein said opening of said bag is closed by said cover strip and an opening position, said tubular member being rotated and said cover strip being wound around said outer surface of said tubular member when said handle member is moved from said closed position to said opening position by the returning force of said torsional spring; and said strip winding and unwinding unit further including a fastening member provided on said side wall of said bag to maintain said handle member in said closed position.

2. A handbag as claimed in claim 1, wherein said parallel portions of said inverted U-shaped handle member has a pair of aligned recesses facing one another, said handling portion of said inverted U-shaped handle member having a wavy inner face, said fastening member including a rectangular member having two opposite upright sides each having a projecting stub received in a respective one of said recesses of said parallel portions, and a wavy bottom face to engage said wavy inner face of said handling portion so as to maintain said handle member in said closed position.

* * * * *